US009352199B2

(12) United States Patent
Seluga et al.

(10) Patent No.: US 9,352,199 B2
(45) **Date of Patent: *May 31, 2016**

(54) GOLF CLUB HEAD WITH CENTER OF GRAVITY ADJUSTABILITY

(71) Applicant: CALLAWAY GOLF COMPANY, Carlsbad, CA (US)

(72) Inventors: James A. Seluga, Carlsbad, CA (US); Denver Holt, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/713,090

(22) Filed: May 15, 2015

(65) Prior Publication Data

US 2015/0246271 A1 Sep. 3, 2015

Related U.S. Application Data

(63) Continuation of application No. 14/159,262, filed on Jan. 20, 2014, now Pat. No. 9,067,110, which is a continuation-in-part of application No. 14/039,102, filed on Sep. 27, 2013, now Pat. No. 8,834,294, which is a continuation of application No. 13/797,404, filed on Mar. 12, 2013, now abandoned, said application No. 14/159,262 is a continuation-in-part of application No. 13/906,572, filed on May 31, 2013, now Pat. No. 8,956,244.

(60) Provisional application No. 61/886,473, filed on Oct. 3, 2013, provisional application No. 61/657,247, filed on Jun. 8, 2012, provisional application No. 61/665,203, filed on Jun. 27, 2012, provisional application No. 61/684,079, filed on Aug. 16, 2012.

(51) Int. Cl.
*A63B 53/06* (2015.01)
*A63B 53/04* (2015.01)

(52) U.S. Cl.
CPC ..... *A63B 53/06* (2013.01); *A63B 53/04* (2013.01); *A63B 53/047* (2013.01); *A63B 53/0466* (2013.01); *A63B 60/42* (2015.10); *A63B 2053/0408* (2013.01); *A63B 2053/0491* (2013.01); *A63B 2060/002* (2015.10); *A63B 2209/02* (2013.01)

(58) Field of Classification Search
CPC ..... A63B 63/06; A63B 53/0466; A63B 59/0074; A63B 53/04; A63B 53/047; A63B 60/42; A63B 2059/003; A63B 2053/0408; A63B 2053/0491; A63B 2060/002; A63B 2209/02
See application file for complete search history.

(56) References Cited

U.S. PATENT DOCUMENTS 4,811,949 A * 3/1989 Kobayashi ..... A63B 53/04 473/337
5,447,309 A * 9/1995 Vincent ..... A63B 53/04 473/335
5,967,904 A * 10/1999 Nagai ..... A63B 53/04 473/345

(Continued)

*Primary Examiner* — Stephen Blau
(74) *Attorney, Agent, or Firm* — Rebecca Hanovice; Michael Catania; Sonia Lari

(57) ABSTRACT

The present invention comprises a golf club head comprising a body having a crown, a sole, a front wall and a hosel, wherein the body defines a hollow interior. The golf club head further comprises a center of gravity adjustment assembly wherein the center of gravity adjustment assembly is positioned within the hollow interior of the body, and allows the center of gravity of the golf club head to be adjusted by at least 0.050 inch, preferably along a vertical axis.

20 Claims, 9 Drawing Sheets

(56) References Cited

U.S. PATENT DOCUMENTS 8,535,173 B2 * 9/2013 Golden ..... A63B 53/02 473/246
8,540,587 B2 * 9/2013 Hirsch ..... A63B 53/0466 473/332
8,591,352 B2 * 11/2013 Hirano ..... A63B 53/0466 473/336
8,992,339 B2 * 3/2015 Matsunaga ..... A63B 53/04 473/335
2002/0137576 A1 9/2002 Dammen
2010/0331102 A1 * 12/2010 Golden ..... A63B 53/0466 473/337
2011/0152003 A1 * 6/2011 Hartwell ..... A63B 53/0466 473/345
2011/0224017 A1 * 9/2011 Thomas ..... A63B 53/0466 473/332

* cited by examiner

GOLF CLUB HEAD WITH CENTER OF GRAVITY ADJUSTABILITY

CROSS REFERENCES TO RELATED APPLICATIONS

The present application is a continuation of U.S. patent application Ser. No. 14/159,262, filed on Jan. 20, 2014, which claims priority to U.S. Provisional Patent Application No. 61/886,473, filed on Oct. 3, 2013, and is a continuation-in-part of U.S. patent application Ser. No. 14/039,102, filed on Sep. 27, 2013, and issued on Sep. 16, 2014, as U.S. Pat. No. 8,834,294, which is a continuation of U.S. patent application Ser. No. 13/797,404, filed on Mar. 12, 2013, which claims priority to U.S. Provisional Patent Application No. 61/657,247, filed on Jun. 8, 2012, U.S. Provisional Patent Application No. 61/665,203 filed on Jun. 27, 2012, and U.S. Provisional Patent Application No. 61/684,079 filed on Aug. 16, 2012, the disclosure of each of which is hereby incorporated by reference in its entirety herein. U.S. patent application Ser. No. 14/159,262 also is a continuation in part of U.S. patent application Ser. No. 13/906,572, filed on May 31, 2013, and issued on Feb. 17, 2015, as U.S. Pat. No. 8,956,244, the disclosure of which is also hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head comprising a center of gravity height adjustability assembly.

2. Description of the Related Art

The prior art discloses various designs with center of gravity adjustments to improve golf club performance, but fails to provide designs that efficiently alter center of gravity parameters while at the same time contributing to an improved impact event with the golf ball.

The United States Golf Association (USGA) has increasingly limited the performance innovations of golf clubs, particularly drivers. Recently, the USGA has limited the volume, dimensions of the head, such as length, width, and height, face compliance, inertia of driver heads and overall club length. Current methods previously used to improve the performance of a driver have been curtailed by limitations on design parameters set by the USGA. An area of driver performance improvement that exists, as of this date, is the potential to adjust the height of the center of gravity. A change in height of the center of gravity changes the amount of backspin provided with a given impact. A higher center of gravity increases spin, while a lower center of gravity decreases spin.

The recent past has shown that driver designs have trended to include characteristics to increase the driver's inertia values to help off-center hits go farther and straighter. Driver designs have also recently included larger faces, which may help the driver deliver better feeling shots as well as shots that have higher ball speeds if hit away from the face center. However, these recent trends may also be detrimental to the driver's performance due to the head speed reductions that these design features introduce due to the larger geometries. The design of the present invention allows for the higher inertias and robust face design of current drivers while at the same time providing center of gravity is adjustability.

BRIEF SUMMARY OF THE INVENTION

One purpose of this invention is to effectively incorporate several design features in the golf club head that will enable both adjustment and optimization of the height of the center of gravity. Another object of the present invention is an adjustable weighting feature for vertical center of gravity control which is entirely concealed from view at address. To improve achieve these goals, a golf club head with an internal center of gravity height adjustment assembly is provided, which affects the moment of inertia and ultimately the forgiveness of the golf club head.

One aspect of the golf club head of the present invention comprises a body having a crown, a sole, a face and a hosel, wherein the body defines a hollow interior, and a center of gravity height adjustment assembly that is positioned within the hollow interior of the body. Preferably, the location of the center of gravity of the golf club head can be adjusted by 0.050-0.100 inch along any axis, but preferably along a vertical Z axis.

Another aspect of the present invention is a golf club head comprising a face, a crown, a sole, a hollow tube, a cap screw, and a cartridge comprising a first material having a first specific gravity and a second material having a second specific gravity that is at least three times the value of the first specific gravity, wherein the tube is disposed within a hollow interior of the golf club head and extends from the crown to the sole, wherein the cartridge is sized to fit within the tube, wherein the tube is accessible via an opening in one of the crown and the sole, and wherein changing the orientation of the carrier within the tube changes the location of the golf club head's center of gravity along a vertical Z axis. In some embodiments, the first material may be selected from the group consisting of a glass filled epoxy, a glass filled polyester, and a glass-filled nylon, and the second material may be tungsten. In another embodiment, the cap screw may comprise external threads, the opening may comprise internal threads, and the cap screw may be sized to fit within the opening such that the external threads engage with the internal threads. In another embodiment, the cap screw may comprise a plurality of cutouts.

In other embodiments, the cartridge may comprise a first end and a second end, and each of the first and second ends may have a shape selected from the group consisting of conically tapered, rounded tapered, and circular. In some further embodiments, the second material may be disposed at the first end, such that the first end is heavier than the second end. In another embodiment, the first end may comprise a first color, and the second end may comprise a second, different color. In another embodiment, the cap screw may comprise a plurality of cutouts, and a portion of the first end or the second end of the cartridge may be visible through the cutouts.

In still other embodiments, the crown may comprise an edge support structure sized to receive an end of the hollow tube. In another embodiment, the face may have a frequency of 3000 to 4010 Hz, and the sole may have a frequency of 2500 to 3100 Hz. In another embodiment, the cartridge may be compressed between the crown and the sole, and the tube may be in tension between the crown and the sole. In a further embodiment, the cap screw may place a compression load on the cartridge that exceeds 50 lbs. In another embodiment, the golf club head may further comprise a first cartridge cap comprising a first color and a second cartridge cap comprising a second color, the first cartridge cap may be affixed to the first end of the cartridge, the second cartridge cap may be affixed to the second end of the cartridge, and the first color may be different from the second color. In a further embodiment, the cap screw may comprise a plurality of cutouts, and a portion of the first cartridge cap or the second cartridge cap may be visible through the cutouts.

Another aspect of the present invention is a golf club head comprising a body comprising a face, a sole, a rear portion, and a hollow interior, and a hollow tube, wherein the hollow tube is disposed within the hollow interior, and wherein the golf club exhibits one distinguished sound peak that has a frequency of at least 3000 Hz and an amplitude that is at least 8 decibels greater than any other sound peak. In some embodiments, the hollow tube may be disposed closer to the face than to the rear portion. In other embodiments, the face may have a frequency of 3000 to 4010 Hz, and the sole may have a frequency of 2500 to 3100 Hz. In another embodiment, the hollow tube may not extend between the crown and the sole.

Yet another aspect of the present invention is a driver-type golf club head comprising a metal body comprising a face and a sole, a composite crown, a hollow tube, a cap screw, and a cartridge comprising a first material having a first specific gravity and a second material having a second specific gravity that is at least three times the value of the first specific gravity, wherein the tube is disposed within a hollow interior of the golf club head, wherein the cartridge is sized to fit within the tube, wherein the cap screw places a compression load on the cartridge that exceeds 50 lbs, and wherein changing the orientation of the carrier within the tube changes the location of the golf club head's center of gravity by at least 0.050 inch.

Another aspect of the present invention is a golf club head comprising a body comprising a face, a sole, and an interior cavity, and an adjustable cartridge that can be removably affixed in the interior cavity in more than one orientation, wherein a distance between a center of gravity of the cartridge and a geometric centroid of the cartridge is defined as ½D, wherein a weight of the cartridge is defined as $M_T$, wherein the combined weight of the body and the cartridge is defined as M, and wherein $D \geq 0.065(1+M/M_T)$.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
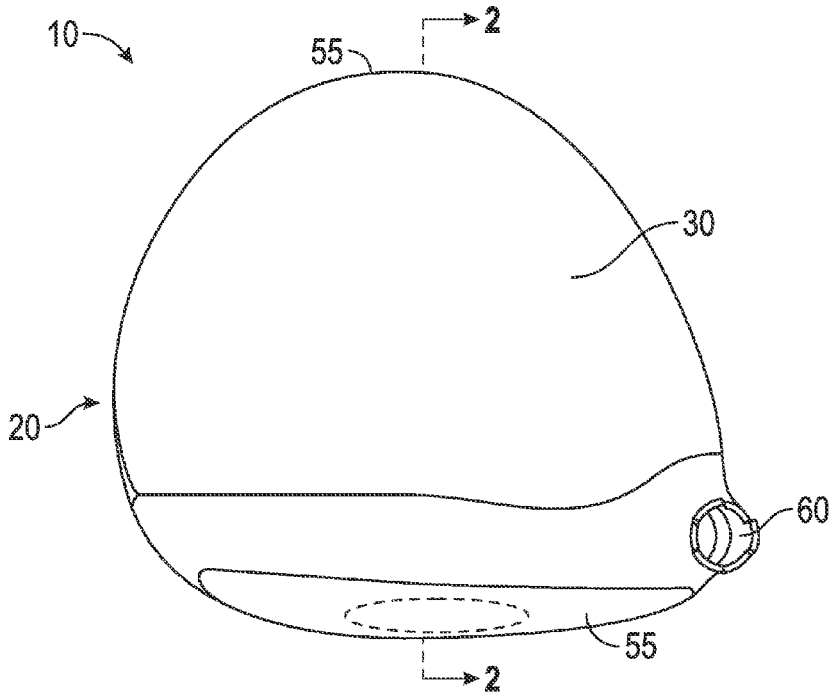
FIG. 1 is a top perspective view of a golf club head according to the present invention.
Figure 2A:
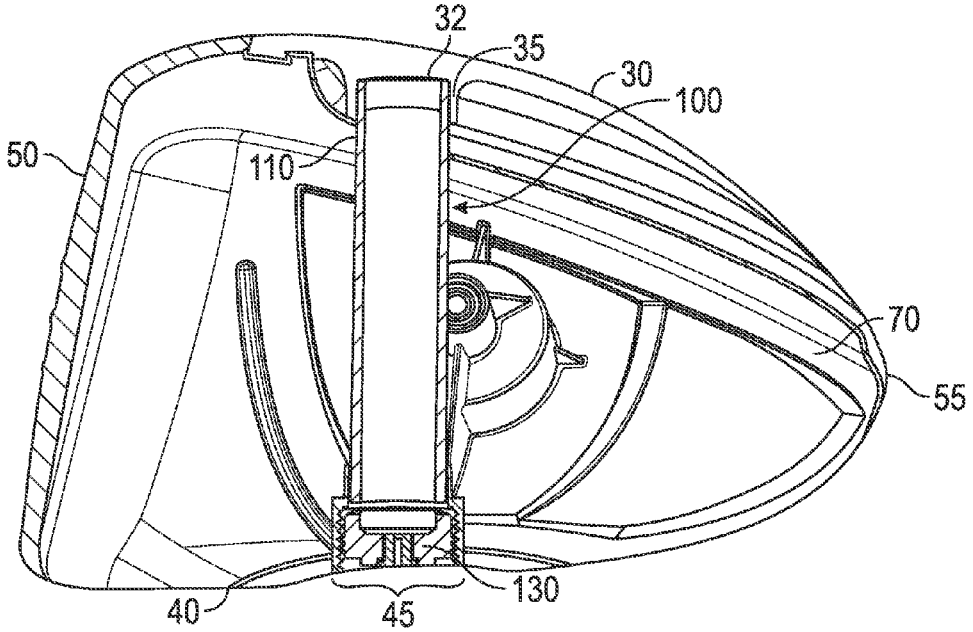
FIG. 2A is a cross sectional view of the golf club head shown in FIG. 1 along lines 2-2, without a cartridge in the tube.
Figure 2B:
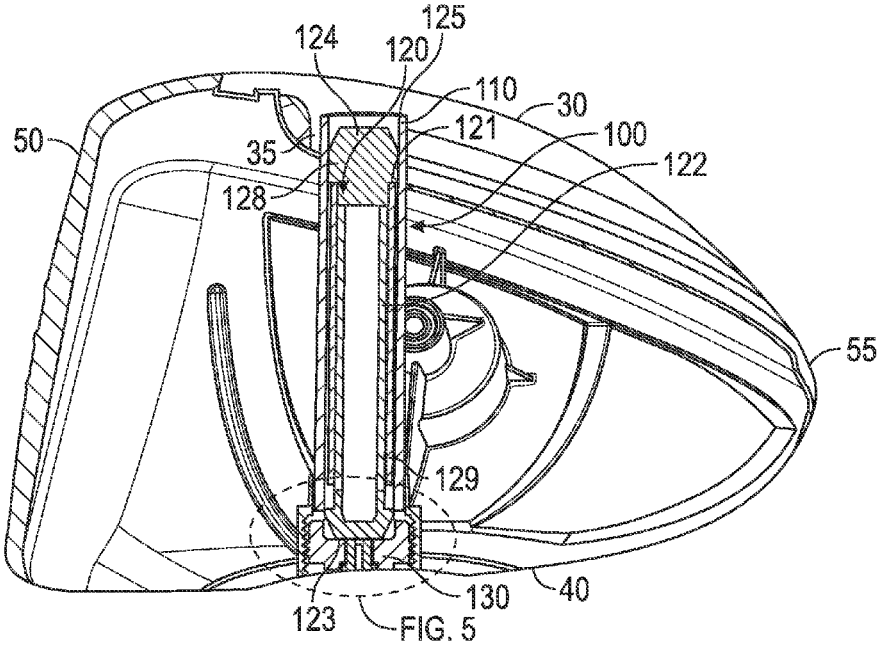
FIG. 2B is a cross sectional view of the golf club head shown in FIG. 1 along lines 2-2, with a cartridge in the tube.

A preferred embodiment of the golf club head 10 of the present invention is shown in FIGS. 1-2A, 2B, 12, and 13. The golf club head 10 includes a crown 30, sole 40, face 50, adjustable hosel 60, and interior cavity 70, and a center of gravity height adjustment assembly 100 positioned within the interior cavity 70 and completely obscured from view when the golf club head 10 is viewed from above and at address. As shown in FIGS. 2A and 2B, the center of gravity height adjustment assembly 100 comprises a hollow tube 110 and a removable cartridge 120. The tube 110 preferably is composed of a carbon composite material, but in alternative embodiments may be composed of Kevlar, fiberglass, plastic, and/or glass-filled plastic (including glass-filled nylon and polycarbonate), and has an extremely low weight, preferably under 5 grams, and more preferably approximately 2 grams. The tube 110 extends from the crown 30 to the sole 40, has a length of less than 3.8 inches, and preferably is accessed via an opening 45 in the sole 40, but in alternative embodiments may be accessible via the crown 30 as well as, or instead of, the sole 40. The center of gravity height adjustment assembly 100 is disposed closer to the face 50 than the rearmost portion 55 of the golf club head 10.

Figure 3A:
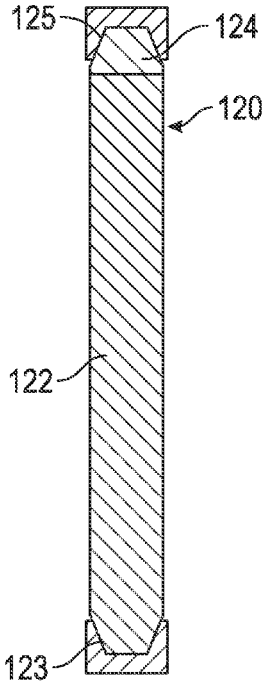
FIGS. 3A, 3B, and 3C are cross sectional views of different cartridges that may be used with the golf club head of the present invention.
Figure 3B:
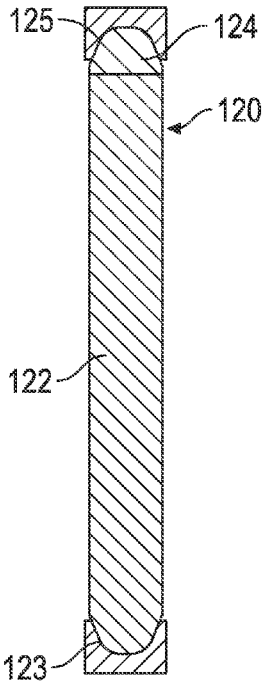
Figure 3C:
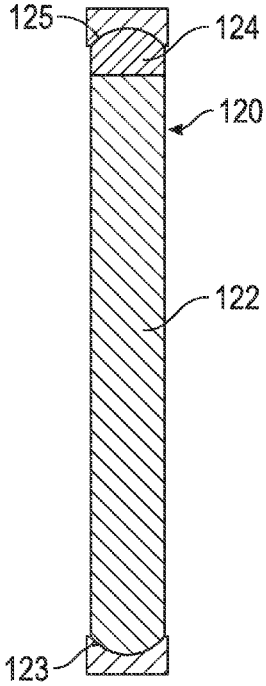
Figure 4:
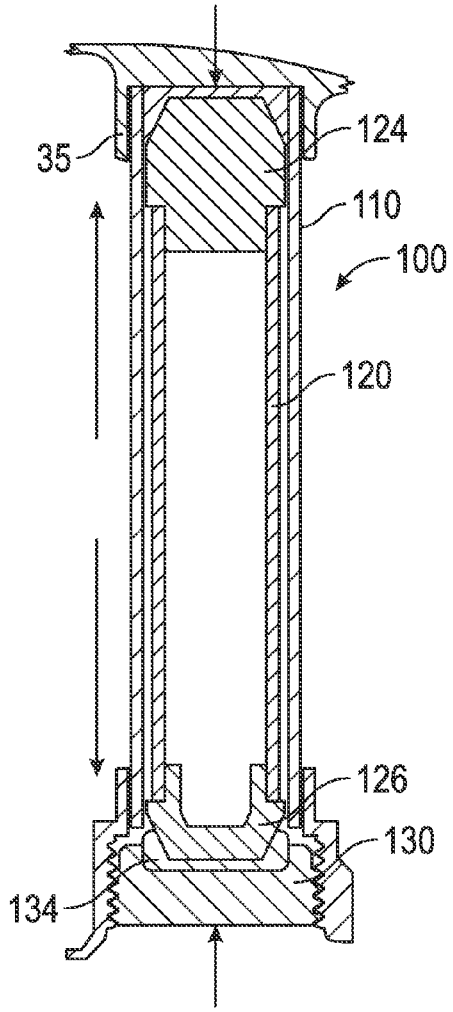
FIG. 4 is a cross-sectional view of another cartridge engaged with the golf club of the present invention that illustrates the forces placed on the tube and cartridge.
Figure 5:
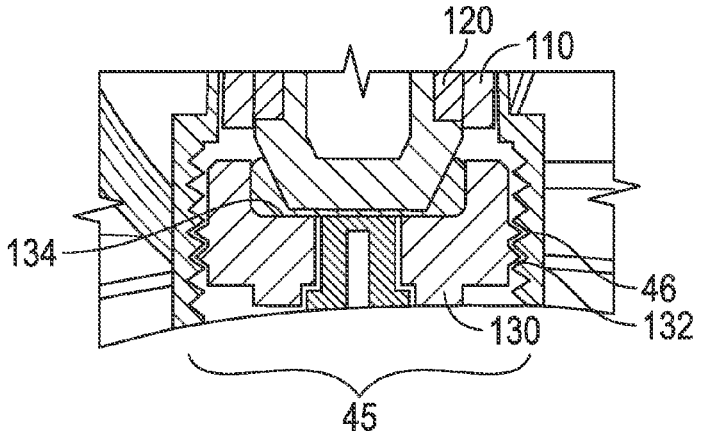
FIG. 5 is an enlarged view of the circled portion in FIG. 2B.
Figure 6:
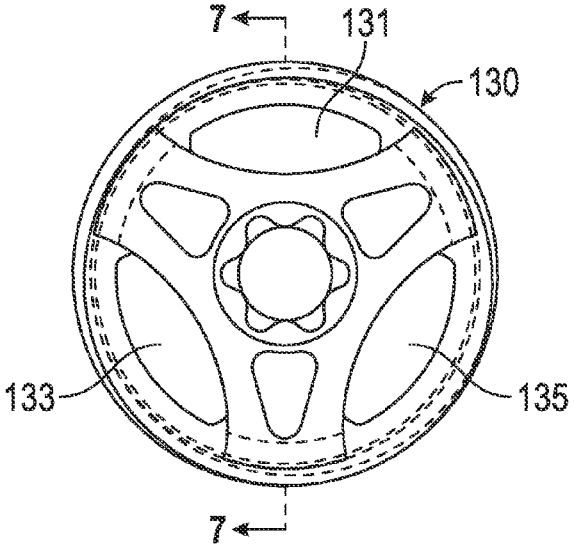
FIG. 6 is a top plan view of a screw cap according to one embodiment of the present invention.
Figure 7:
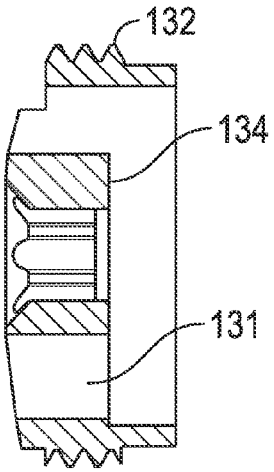
FIG. 7 is a cross-sectional view of the screw cap shown in FIG. 6 along lines 7-7.
Figure 8A:
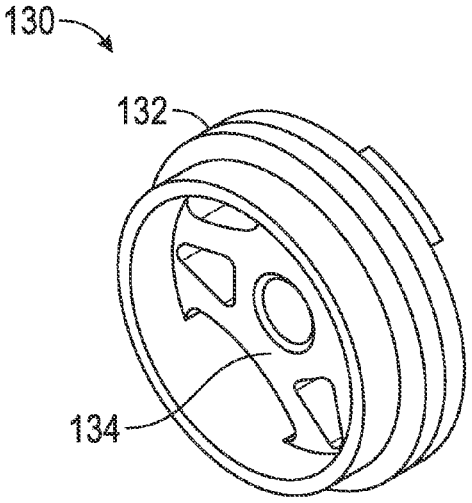
FIGS. 8A and 8B are rear and front perspective views of the screw cap shown in FIG. 6.
Figure 8B:
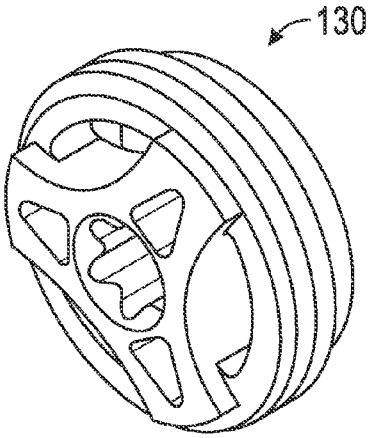

The cartridge 120 is sized to fit snugly within the tube 110, and is composed of at least two different materials. The first material 122 preferably is a polymer material, such as urethane, or more preferably a glass-filled plastic, nylon, or epoxy, while the second material 124, which preferably is a tungsten alloy, has a specific gravity that is at least three times greater than the specific gravity of the first material 122. As shown in FIG. 2B, the second material 124 preferably is provided in the form of a slug 124, which is disposed at a first end 121 of the cartridge 120 such that the cartridge 120 has a heavy side 128 and a light side 129. The slug 124 includes a tapered end 125 that has the same dimensions as the second end 123 of the cartridge 120, which is also tapered. The tapering on the second end 123 of the cartridge 120 can be provided by a separate cartridge cover 126, as shown in FIG. 4, but is preferably integrally formed with the first material of the cartridge 120. While the slug 124 and cartridge 120 ends 125, 123 are preferably sharply conically tapered as shown in FIGS. 2B and 3A, they may have rounded tapering as shown in FIG. 3B, or be circular as shown in FIG. 3C.

When the cartridge 120 is fully inserted into the tube 110, it is retained therein with a cap screw 130. The opening 45 in the sole 40 comprises internal threads 46, and the cap screw 130 comprises external threads 132 that mate with the internal threads 46 of the opening 45 in the sole 40. When the cap screw 130 is fully screwed into the opening, the inner surface 134 of the cap screw 130 abuts whichever end 123, 125 of the cartridge 120 is proximate the sole 40 and presses the cartridge 120 against the interior surface 32 of the crown 30. Therefore, the cartridge 120 is placed in compression when it is properly disposed in the tube 110 and when the cap screw 130 is torqued with a wrench or other such tool. The cap screw 130 preferably places a compression load on the cartridge 120 that exceeds 50 lbs. In contrast, the tube 110 preferably is slightly shorter in length than the distance between the crown 30 and the sole 40, such that the tube 110 is in tension, as shown in FIG. 4.

In addition to providing the function of trapping and compressing the cartridge 120 within the tube 110, the cap screw 130 of the preferred embodiment also includes a window feature that allows a user to view the orientation of the cartridge 120 within the tube 110 without having to remove the cap screw 130 and the cartridge 120 from the golf club head 10. As shown in FIGS. 5-8B, the cap screw 130 includes cutouts 131, 133, 135 in the cap screw 130 that may be filled in with a translucent material such as glass or plastic or, in the preferred embodiment, be left open to reduce the overall weight of the golf club head 10. The cartridge ends 123, 125 preferably are painted different colors or are marked to indicate orientation, such that when a user looks at the cap screw 130, he or she can see the colors or markings through one or more of the cutouts 131, 133, 135 and infer the orientation of the cartridge 120 within the tube 110.

Figure 9A:
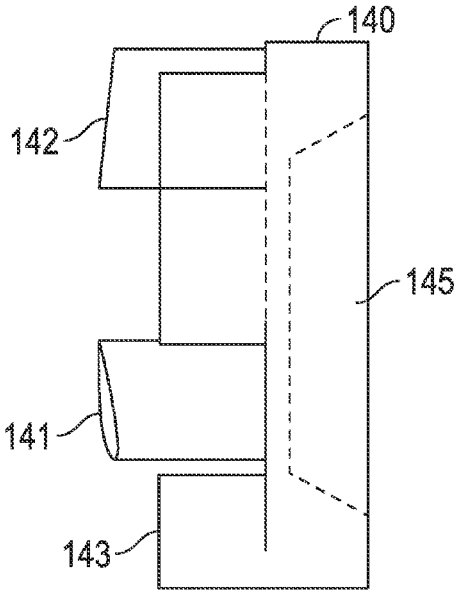
FIGS. 9A, 9B, and 9C are side plan, top plan, and cross-sectional views of a cartridge cap according to one embodiment of the present invention.
Figure 9B:
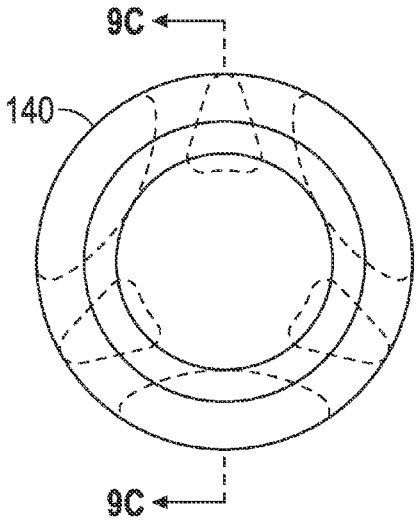
Figure 9C:
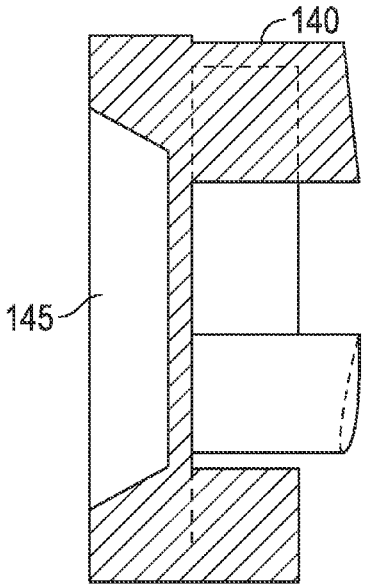
Figure 10:
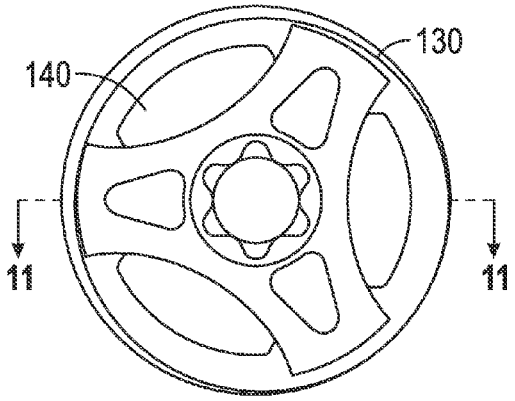
FIG. 10 is a top plan view of the screw cap shown in FIG. 6 engaged with the cartridge cap shown in FIG. 9A.
Figure 11:
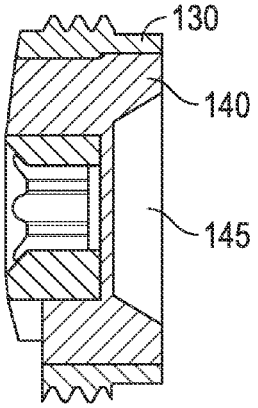
FIG. 11 is a cross sectional view of the screw cap and cartridge cap shown in FIG. 10 along lines 11-11.

In another embodiment, an additional cartridge cap 140, an example of which is shown in FIGS. 9A-9C, may be affixed to both ends 123, 125 of the cartridge 120. This cartridge cap 140 includes a cavity 145 to receive the ends 123, 125 of the cartridge 120, and projections 141, 142, 142 that extend into the cutouts 131, 133, 135 of the cap screw 130 when these two parts 130, 140 are engaged with one another, as shown in FIGS. 10 and 11, thus closing the cutouts 131, 133, 135 off and preventing debris from entering the cap screw 130 when the golf club head 10 is in use. Each cartridge cap 140 preferably is painted a different color so that a user can immediately determine, upon looking at the cap screw/cartridge cap 130, 140 combination, how the cartridge 120 is oriented within the tube 110.

Figure 12:
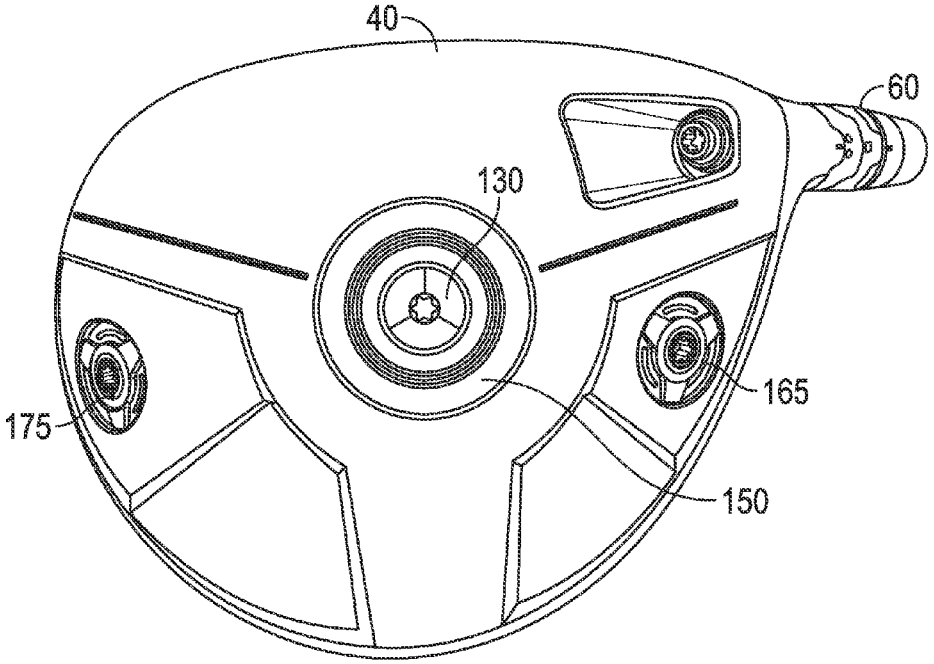
FIG. 12 is a sole perspective view of the golf club head shown in FIG. 1.

In another embodiment, shown in FIG. 12, the cap screw 130 is encircled by a separate sole plate 150, which preferably is attached to the sole 40 of the golf club head 10 beneath the center of gravity height adjustment assembly 100. In some embodiments, this sole plate 150 includes an uneven surface for the purpose of adjusting the face angle of the golf club head 10.

Figure 13:
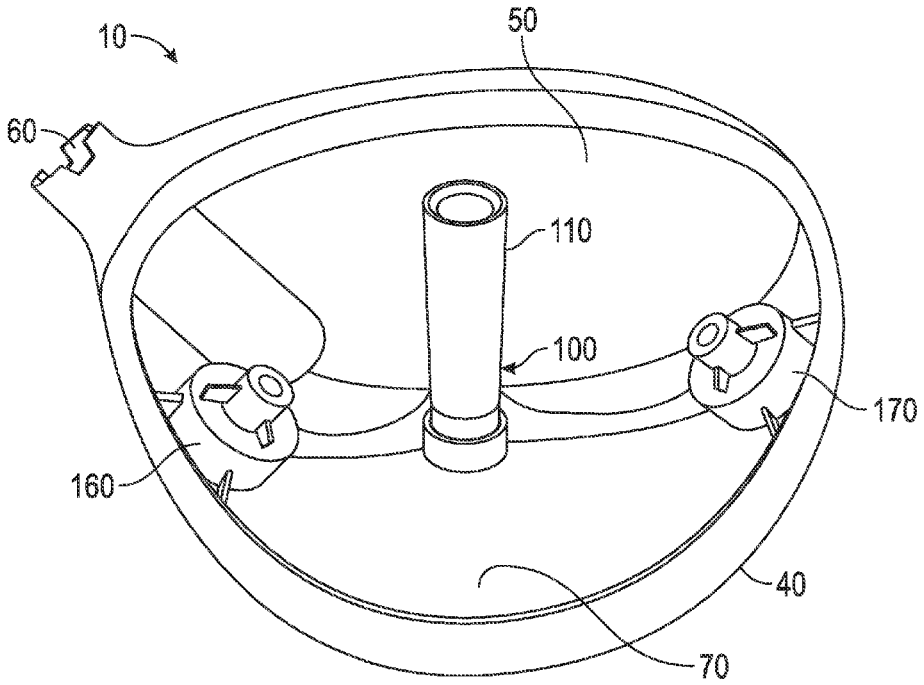
FIG. 13 is a top perspective view of the golf club head shown in FIG. 1 without its crown.

As shown in FIGS. 12 and 13, the preferred embodiment of the present invention includes at least two weight ports 160, 170, one on each side of the center of gravity adjustment assembly 100, which are sized to receive removable weights 165, 175. Alternative embodiments may include additional weight ports disposed in the crown 30, sole 40, or ribbon/skirt area (not shown) of the golf club head.

Figure 14:
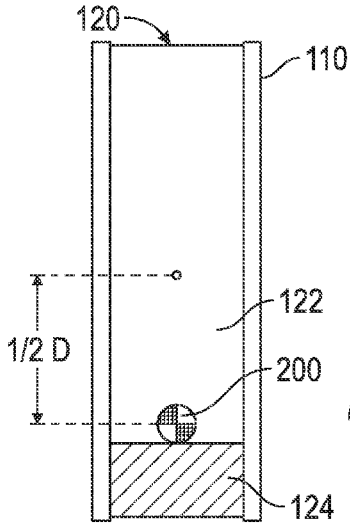
FIG. 14 is a side perspective view of the center of gravity height adjustment assembly of the present invention comprising a tube and a cartridge wherein the distance from the midpoint of the tube to the center of gravity is shown.
Figure 15:
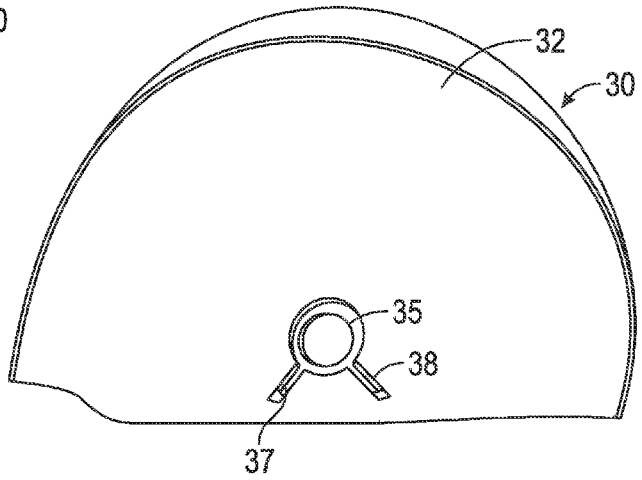
FIG. 15 is a plan view of an inner surface of the crown of the golf club head shown in FIG. 1.

In the preferred embodiment, the golf club head 10 and cartridge 120 have a mass M, the cartridge 120 has a length L and a mass $M_T$, the distance from the midpoint of the length L to a center of gravity 200 of the cartridge when the cartridge 120 is disposed within a club head 10 is defined as ½D as shown in FIG. 14, and the golf club head 10 satisfies the equation $D \geq 0.065(1+M/M_T)$. In other embodiments, the cartridge 120 can be placed or affixed to the golf club head 10 at more than one orientation and has a distance between its geometric centroid and its center of gravity 200 of ½D, and when combined with a golf club head 10 satisfies the equation $D \geq 0.065(1+M/M_T)$ in which the M is mass of the golf club head 10 and cartridge 120 and $M_T$ is the mass of the cartridge 120.

In the preferred embodiment disclosed herein, the interior surface 32 of the crown 30 includes a ring-shaped edge support structure 35 to hold the weighting system. This edge support structure 35 preferably is integrally molded from the crown 30 parent material, which preferably is a composite, but may in alternative embodiments be secondarily bonded to the crown 30. The edge support structure 35 preferably includes two ribs 37, 38 with a width of approximately 0.090 inch, a length of 0.407 inch, and a height of 0.236 inch, and serves to increase stiffness of the crown 30 to counteract the mass effect of the center of gravity height adjustment assembly 100, thus mitigating effects on vibrational behavior. In this manner the edge support structures 35 serve two functional roles; stiffener and tube 110 holder.

The edge support structure 35 also affects the sound of the golf club head 10 when it impacts a golf ball, as do other weights that are affixed to the golf club head 10. In particular, varying the amount of weight in the crown 30 and sole 40 has an effect on driver sound at impact. A relatively flexible weight will mass load the crown, thus affecting vibration modes with significant crown participation. This effect can be mitigated by the use of the edge support structure 35 and matching the stiffness of the center of gravity height adjustment assembly 100 to the local crown 30 structure.

The center of gravity adjustment height assembly 100 beneficially affects the sound of the golf club head 10. The presence of the center of gravity adjustment assembly 100, and particularly the tube 110, has a positive effect on the sound and feel of the golf club head 10 during performance. The tube 110 also increases the stiffness of the sole 40, and thus reduces the sound made by the sole 40 when the golf club head 10 strikes a golf ball, particularly when the tube 110 is disposed proximate the face 50 of the golf club head 10 like in the preferred embodiment. The sole 40 has a sound mode that is split into a higher frequency mode and a lower frequency mode, both of which have lower amplitudes when a tube 110 is located closer to the face 50 than to the rearmost portion 55 of the golf club head 10 as shown in FIGS. 2A and 2B. Tables 1 and 2 show sound measurements taken at three points on a traditional golf club head and the preferred embodiment of the golf club head 10.

TABLE 1

| | MODE | | | | | |
|---|---|---|---|---|---|---|
| | | sole | | | | face |
| Traditional Golf Club Head | | | | | | |
| frequency (Hz) | | | A | 2810 | B | 3940 (baseline) |
| Amplitude (dB) | | | | 109 | | 104 (baseline) |
| Preferred Embodiment | | | | | | |
| frequency (Hz) | 1 | 2520 | 2 | 3100 | 3 | 4010 |
| Amplitude (dB) | | 96.1 | | 97.9 | | 102 |

TABLE 2

| | MODE | | | | | |
|---|---|---|---|---|---|---|
| | | sole | | | | face |
| Traditional Golf Club Head | | | | | | |
| frequency (Hz) | | | A | 71% | B | 100% (baseline) |
| Amplitude (dB) | | | | 105% | | 100% (baseline) |
| Preferred Embodiment | | | | | | |
| frequency (Hz) | 1 | 64% | 2 | 79% | 3 | 102% |
| Amplitude (dB) | | 92% | | 94% | | 98% |

Figure 16:
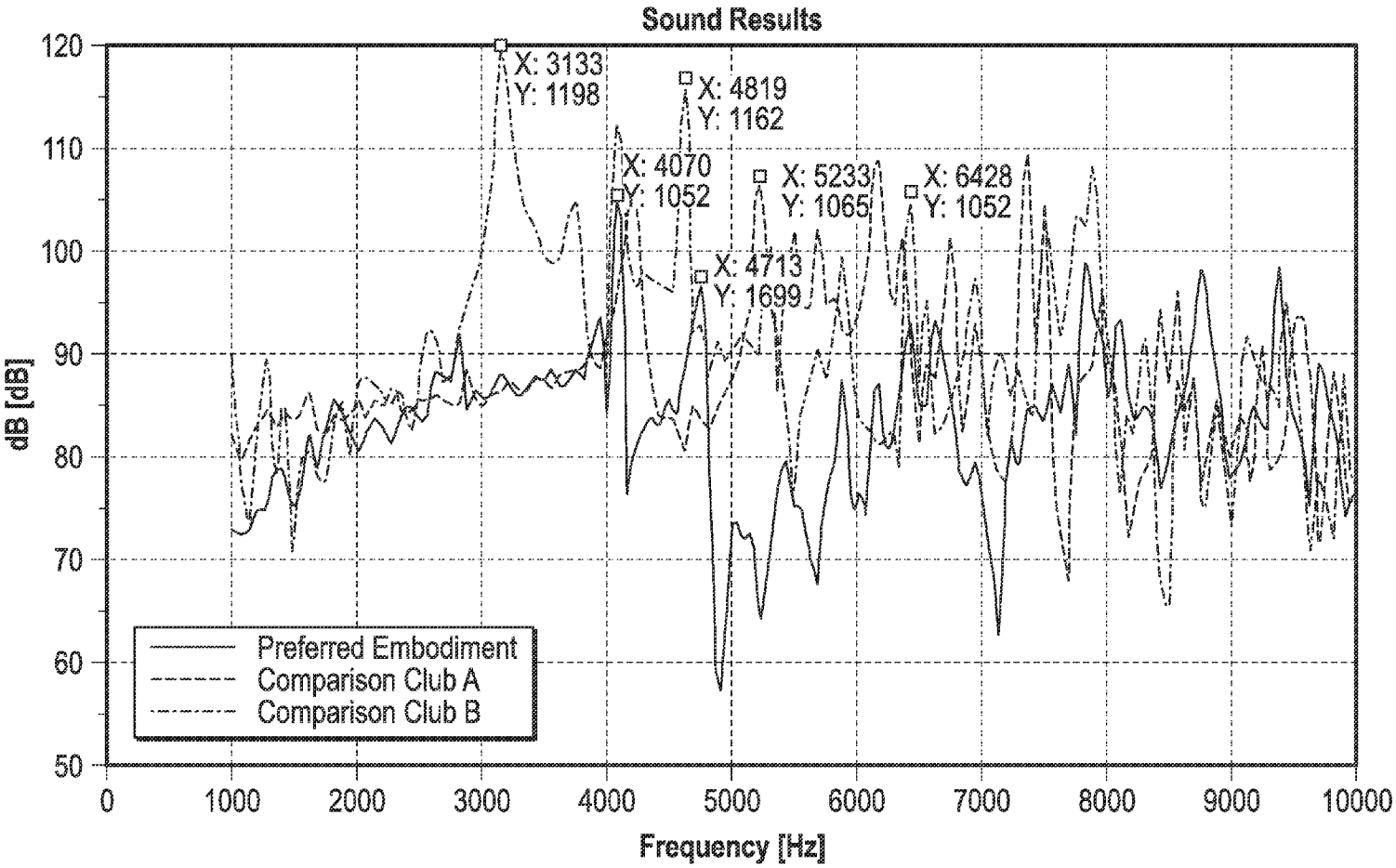
FIG. 16 is a chart comparing sound results of the preferred embodiment of the present invention with two other adjustable weight drivers that do not include the center of gravity adjustment assembly of the present invention.

As shown in Tables 1 and 2, the center of gravity height adjustment assembly 100 included in the preferred embodiment minimizes amplitude (dB) of the sole 40 compared to the traditional golf club head construction, while keeping the face 50 amplitude within a desired range of approximately 3000 to 4000 Hz, and while remaining at the highest amplitude in the system. The presence of the tube 110 thus improves the overall sound quality and durability of the golf club head 10, which allows for the use of cheaper metals and cheaper manufacturing processes. The tube 110 also creates a peak that is more than 8 dB higher than all other peak frequencies of the preferred embodiment, and which is greater than 3000 Hz, as shown in FIG. 16. As shown in FIG. 16, this type of peak is not present in equivalent golf club heads having adjustable weighting but lacking the tube 110 of the present invention. The preferred sound of a driver-type golf club is in the 3000-6000 Hz range, and it is preferable to have only one peak with an amplitude of 8-20 db greater than other peaks.

Figure 17:
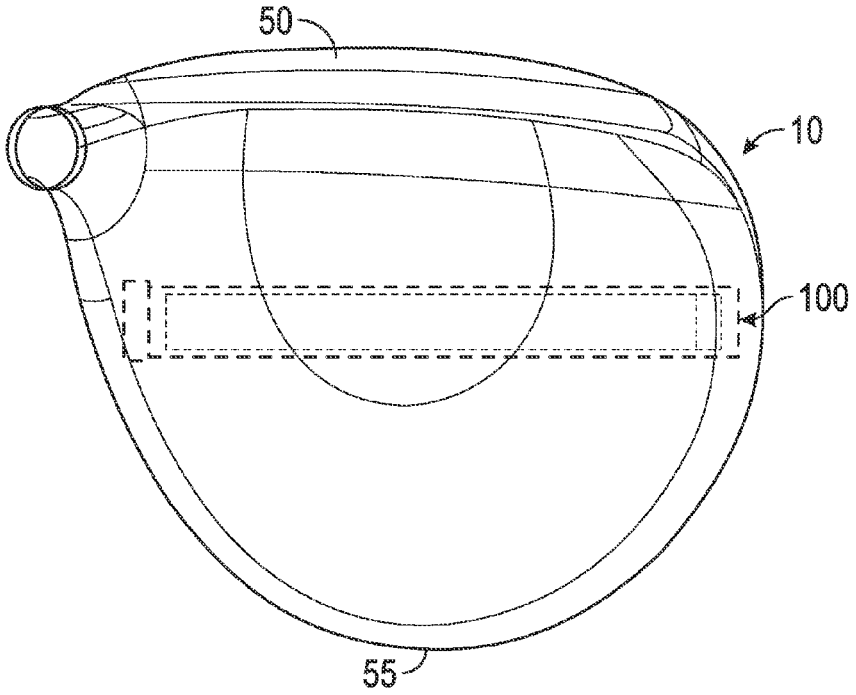
FIG. 17 is a transparent, top perspective view of an alternative embodiment of the golf club head of the present invention.
Figure 18:
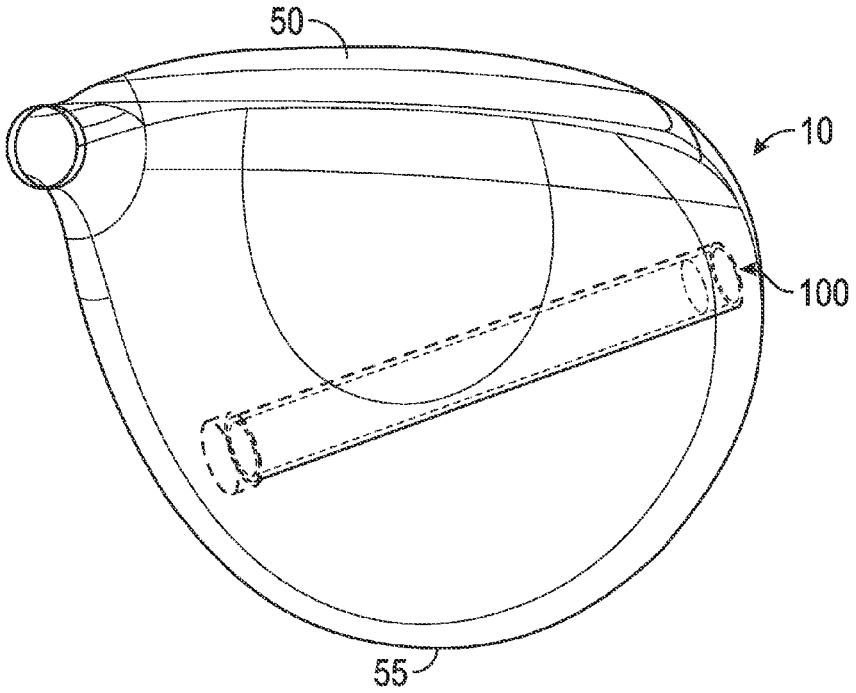
FIG. 18 is a transparent, top perspective view of an alternative embodiment of the golf club head of the present invention.

As shown in FIGS. 2A, 2B, 13, and 14, the center of gravity height adjustment assembly 100 preferably is located within the interior cavity 70 of the golf club head 10 in a crown 30 to sole 40 direction, running parallel to the tangent vector of the face 50, and the center of gravity height adjustment preferably occurs in the vertical Z-axis plane. In alternative embodiments, shown in FIGS. 17 and 18, the center of gravity height adjustment assembly 100 can be disposed anywhere within the interior cavity 70 of the golf club head 10, and can extend diagonally or horizontally from different locations within the golf club head 10.

The design approach described herein is based on the construction used in the Callaway Golf Company RAZR Fit driver head, characterized by a composite crown adhesively bonded to a cast titanium body, which includes a face, sole, and adjustable hosel. However, this center of gravity adjustment assembly may be used with other golf club head constructions, including all titanium, all composite, and a composite body with a metal face cup. It may also be used with other type of golf club heads, including fairway woods, hybrids, and utility irons. It is also intended to work in conjunction with at least one adjustable weight port disposed anywhere on the club head, including the crown and sole, and a slidable weight.

The disclosure of each of U.S. Pat. Nos. 7,147,573, 7,163,468, 7,163,470, 7,166,038, 7,214,143, 7,252,600, 7,258,626, 7,258,631, 7,273,419, 8,337,328, 8,317,636, and 8,262,506 is hereby incorporated by reference herein in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a face;

a crown;

a sole;

a hollow tube;

a cap screw; and a cartridge comprising a first material having a first specific gravity and a second material having a second specific gravity that is at least three times the value of the first specific gravity, wherein the tube is disposed within a hollow interior of the golf club head and extends from the crown to the sole, wherein the cartridge is sized to fit within the tube, wherein the tube is accessible via an opening in one of the crown and the sole, wherein the cartridge is compressed between the crown and the sole, wherein the cap screw places a compression load on the cartridge that exceeds 50 lbs, wherein the tube is in tension between the crown and the sole, and wherein changing the orientation of the carrier within the tube changes the location of the golf club head's center of gravity along a vertical Z axis.

2. The golf club head of claim 1, wherein changing the orientation of the carrier within the tube changes the location of the golf club head's center of gravity by at least 0.050 inch.

3. The golf club head of claim 1, wherein the first material is selected from the group consisting of a glass filled epoxy, a glass filled polyester, and a glass-filled nylon, and wherein the second material is tungsten.

4. The golf club head of claim 1, wherein the cap screw comprises external threads, wherein the opening comprises internal threads, and wherein the cap screw is sized to fit within the opening such that the external threads engage with the internal threads.

5. The golf club head of claim 1, wherein the cap screw comprises a plurality of cutouts.

6. The golf club head of claim 5, wherein the second material is disposed at the first end, such that the first end is heavier than the second end.

7. The golf club head of claim 5, wherein the first end comprises a first color, wherein the second end comprises a second color, and wherein the first color is different from the second color.

8. The golf club head of claim 5, wherein the cap screw comprises a plurality of cutouts, and wherein a portion of the first end or the second end of the cartridge is visible through the cutouts.

9. The golf club head of claim 5, further comprising a first cartridge cap comprising a first color and a second cartridge cap comprising a second color, wherein the first cartridge cap is affixed to the first end of the cartridge, wherein the second cartridge cap is affixed to the second end of the cartridge, and wherein the first color is different from the second color.

10. The golf club head of claim 1, wherein the cartridge comprises a first end and a second end, and wherein each of the first and second ends has a shape selected from the group consisting of conically tapered, rounded tapered, and circular.

11. The golf club head of claim 10, wherein the first material has a first specific gravity, and wherein the second material has a second specific gravity that is at least three times the value of the first specific gravity.

12. The golf club head of claim 1, wherein the crown comprises an edge support structure sized to receive an end of the hollow tube.

13. The golf club head of claim 1, wherein the face has a frequency of 3000 to 4010 Hz.

14. The golf club head of claim 1, wherein the sole has a frequency of 2500 to 3100 Hz.

15. The golf club head of claim 14, wherein the cap screw comprises a plurality of cutouts, and wherein a portion of the first cartridge cap or the second cartridge cap is visible through the cutouts.

16. The golf club head of claim 1, wherein the golf club exhibits one distinguished sound peak that has a frequency of at least 3000 Hz and an amplitude that is at least 8 decibels greater than any other sound peak.

17. The golf club head of claim 1, wherein the tube is disposed closer to the face than to the rear portion.

18. The golf club head of claim 1, wherein the golf club head is a driver-type golf club head.

19. The golf club head of claim 18, wherein the face and the sole are composed of a metal material, and wherein the crown is composed of a composite material.

20. The golf club head of claim 1, wherein a distance between a center of gravity of the cartridge and a geometric centroid of the cartridge is defined as ½D, wherein a weight of the cartridge is defined as $M_T$, wherein the combined weight of the body and the cartridge is defined as M, and wherein $D \geq 0.065(1+M/M_T)$.

* * * * *